US012338754B1

(12) United States Patent
Shah et al.

(10) Patent No.: US 12,338,754 B1
(45) Date of Patent: Jun. 24, 2025

(54) ENGINE OIL PAN

(71) Applicant: RB Distribution, Inc., Colmar, PA (US)

(72) Inventors: Rajan Shah, Eagleview, PA (US); Joshua Bloch, Eagleville, PA (US); Kyle Pfender, Colmar, PA (US); Patrick Kennedy, Hatboro, PA (US)

(73) Assignee: RB Distribution, Inc., Colmar, PA (US)

( * ) Notice: Subject to any disclaimer, the term of this patent is extended or adjusted under 35 U.S.C. 154(b) by 0 days.

(21) Appl. No.: 18/597,097

(22) Filed: Mar. 6, 2024

(51) Int. Cl.
*F01M 11/00* (2006.01)
*F01M 11/04* (2006.01)

(52) U.S. Cl.
CPC ..... *F01M 11/0004* (2013.01); *F01M 11/0408* (2013.01); *F01M 2011/007* (2013.01)

(58) Field of Classification Search
CPC ..... F01M 2011/007; F01M 11/0408; F01M 11/004
See application file for complete search history.

(56) References Cited

U.S. PATENT DOCUMENTS 3,097,663 A * 7/1963 Buchwald ..... F01M 11/0004 184/106
4,915,852 A * 4/1990 Tomlinson ..... B01D 35/027 184/6.24
2004/0177827 A1* 9/2004 Hoyte ..... F01M 11/0004 123/196 AB
2011/0011367 A1* 1/2011 Staley ..... F01M 5/02 123/196 R
2015/0129471 A1* 5/2015 Beer ..... B01D 35/005 210/167.08
2023/0417164 A1* 12/2023 Ott ..... F01M 11/0004

* cited by examiner

*Primary Examiner* — Kevin A Lathers
(74) *Attorney, Agent, or Firm* — Volpe Koenig

(57) ABSTRACT

An engine oil pan has side walls and bottom wall that define an oil reservoir. The bottom wall has a plurality of attachments positions and oil drain plug with an open end below the lowest portion of the bottom wall. An oil pickup is secured to the bottom wall at the plurality of attachment positions. The plurality of attachment positions have threaded inwardly and outwardly projecting portions for receiving threaded fasteners.

11 Claims, 8 Drawing Sheets

ENGINE OIL PAN

BACKGROUND OF THE INVENTION

An engine oil pan, also known as an oil reservoir or oil sump, is a crucial component in an internal combustion engine. The oil pan is a reservoir for the engine's lubricating oil so it can and circulate throughout the engine for proper lubrication. The oil pan is typically bolted to the bottom of the engine block with a seal to prevent leaks. The design and shape of engine oil pans varies depending on the make and model of the vehicle, and is often shaped or configured to fit the vehicle's chassis. Typically, there is an oil drain plug positioned in the bottom of the pan that is removed for an oil change. Some oil pans have baffles and gaskets that help control the flow of oil within the pan and prevent oil starvation during high-speed or high-G turns. The oil pan functions as the reservoir for the lubricating oil that keeps the engine's components working smoothly and efficiently.

Many newer oil pans are molded from plastic materials that can suffer material fatigue from temperature cycling, or damage due to impacts or hits with the road or from road debris. Additionally, material fatigue can result in some components within the oil pan becoming dislodged and possibly loose within the pan.

SUMMARY OF THE INVENTION

The disclosed solution provides an oil pan with a reservoir that has an oil pickup that securely fastened to the bottom of the pan with mechanical fasteners at multiple attachment points. The disclosed pan also has drain spout that is projected downwardly from the bottom of the pan on an axis that is not perpendicular to a plan including the bottom of the pan.

DETAILED DESCRIPTION

Figure 1:
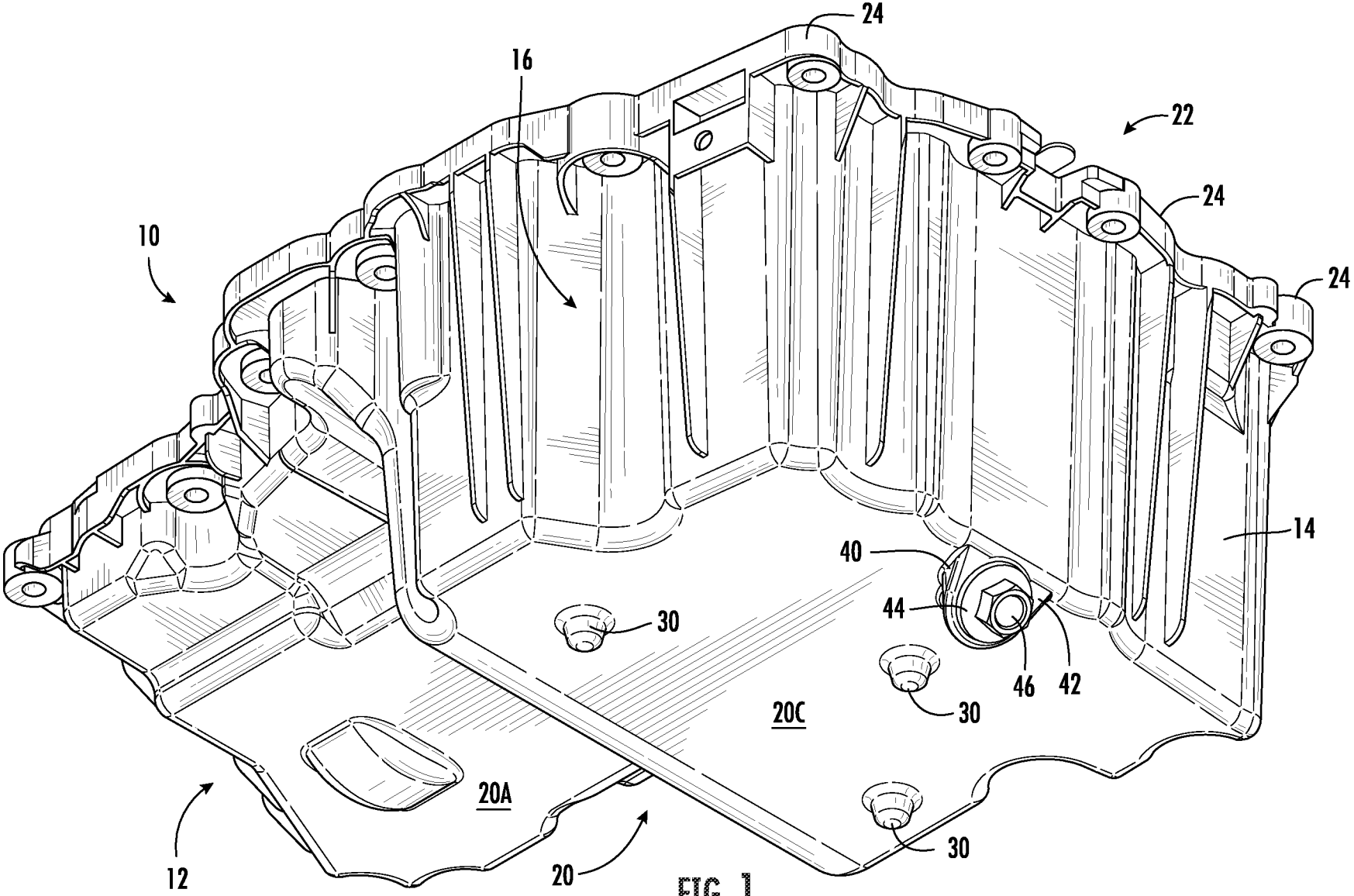
FIGS. 1 and 2 are bottom perspective views of an oil pan illustrating the drain plug position and locations for fasteners.
Figure 2:
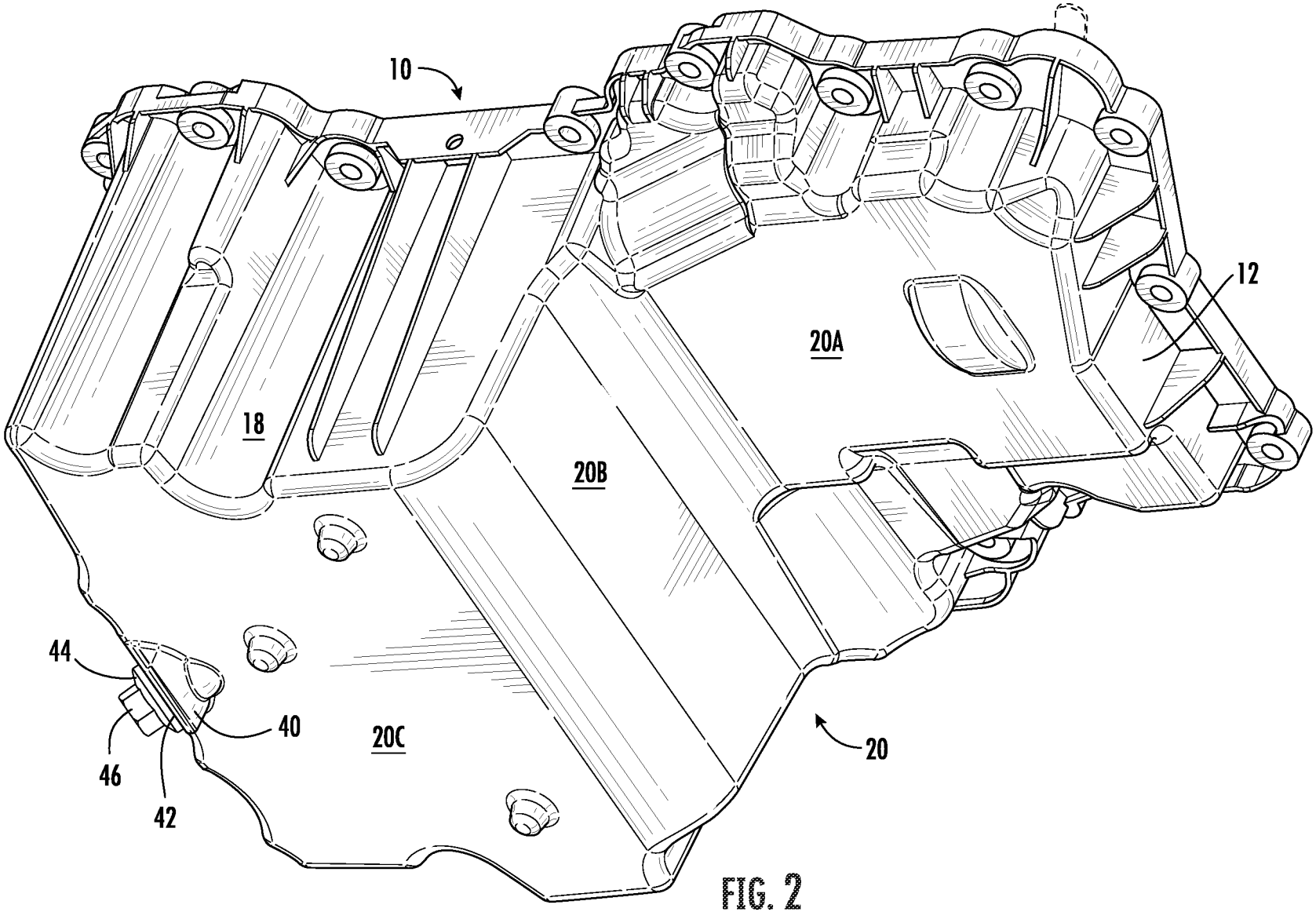

The oil pan illustrated in the drawings will be described in more detail with reference to the figures wherein the same or like structural features are identified with the same numeral.

With reference to FIGS. 1 through 5, the oil pan 10 has a front wall 12, a rear wall 14 and side walls 16 and 18. The bottom wall 20 that joins the walls 12-14 in an oil container or reservoir has multiple sections 20A, 20B, and 20C that are typically shaped to conform to a vehicle chassis. The wall 20C forms the lowest part of the oil pan 10 and this segment serves as the principle oil reservoir. This exterior structure or envelope of the oil pan 10 will be determined by the vehicle for which it is intended. The intended use of the oil pan may alter the structure or envelope but that alteration does not alter the structural features detailed below.

Figure 3:
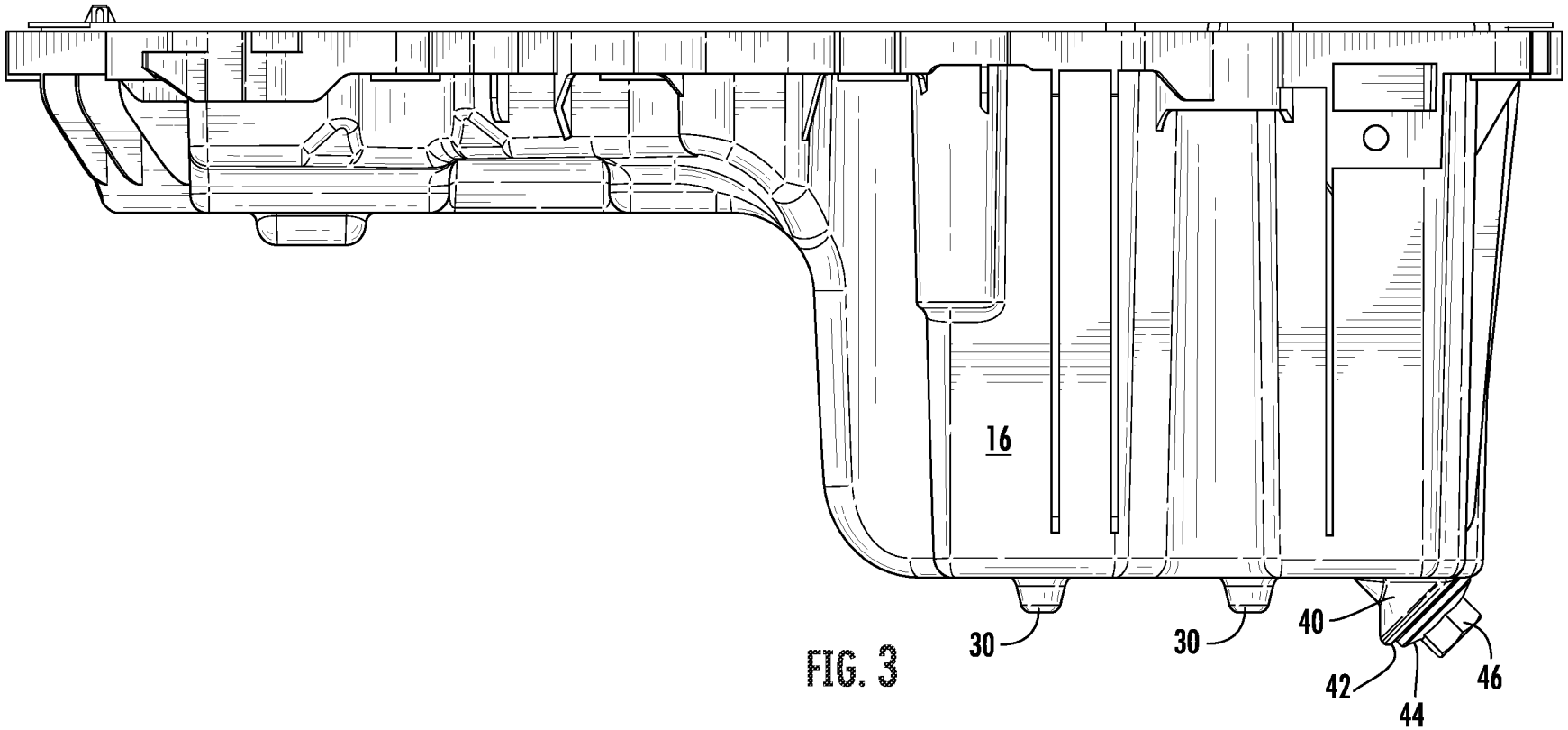
FIG. 3 is a side elevation of the oil pan in FIGS. 1 and 2.
Figure 4:
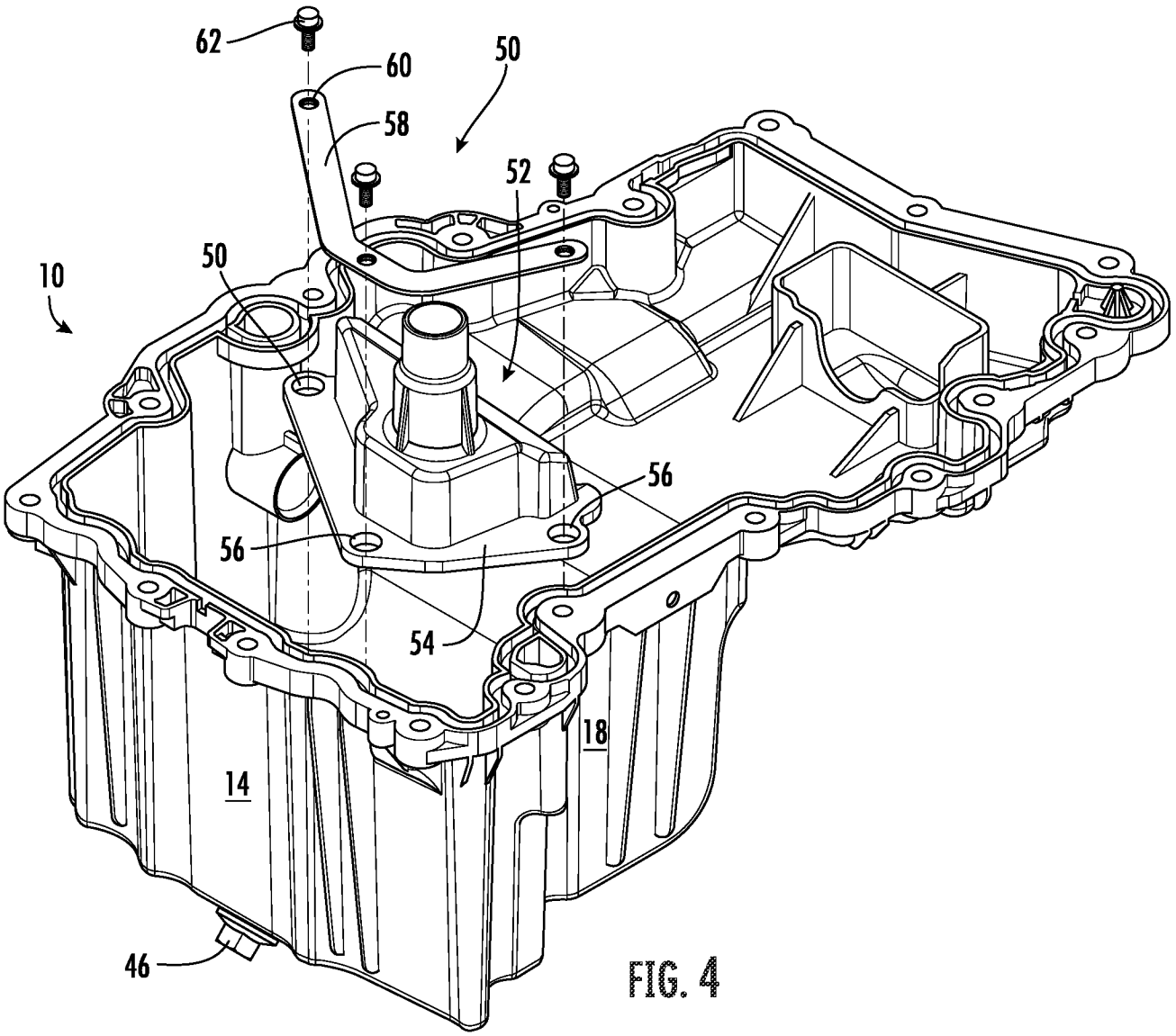
FIG. 4 is a perspective view of the oil pan with an illustrative oil pickup exploded above the oil pan.
Figure 5:
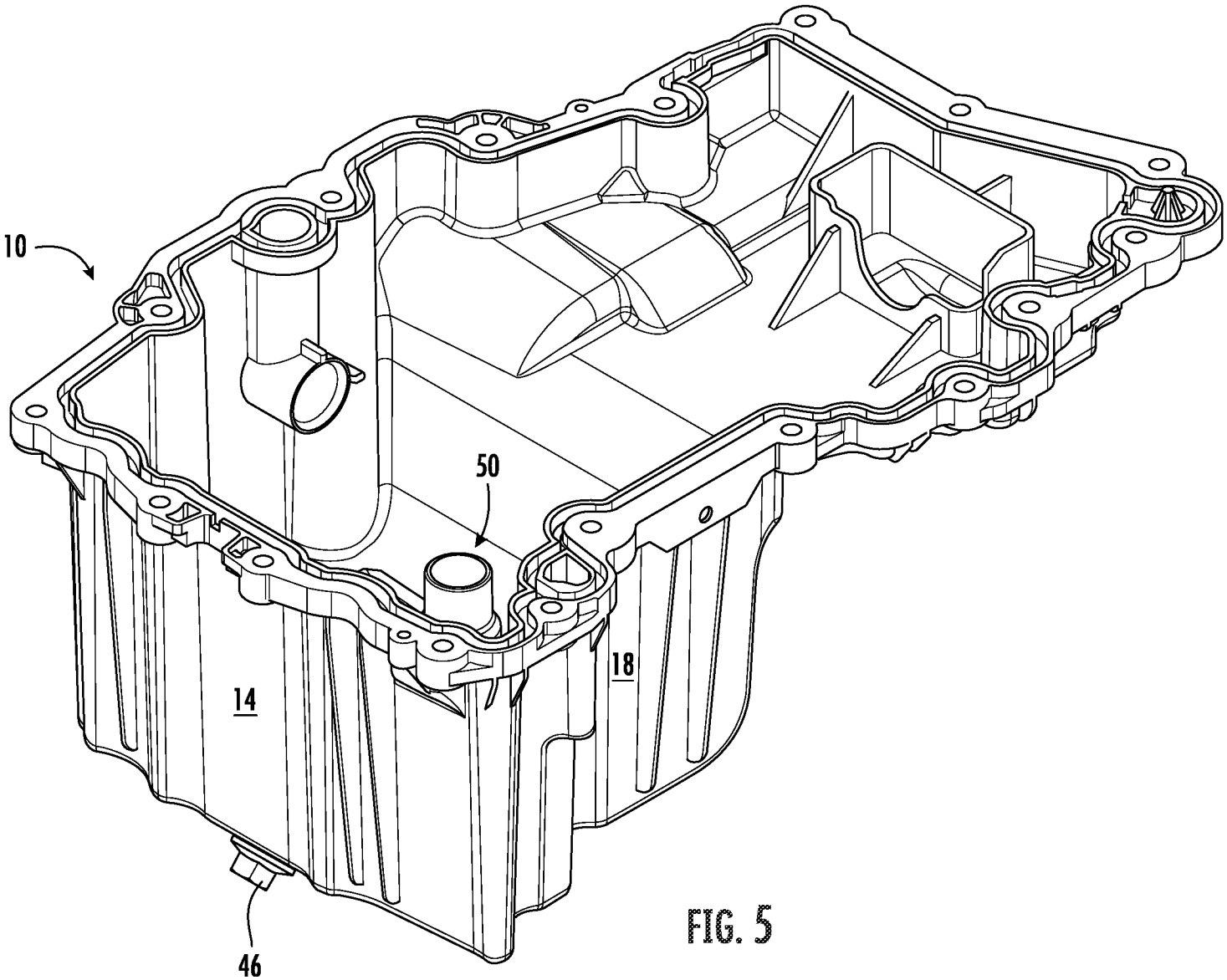
FIG. 5 is a top perspective view of the oil pan with the illustrative oil pickup in the oil pan.
Figure 6:
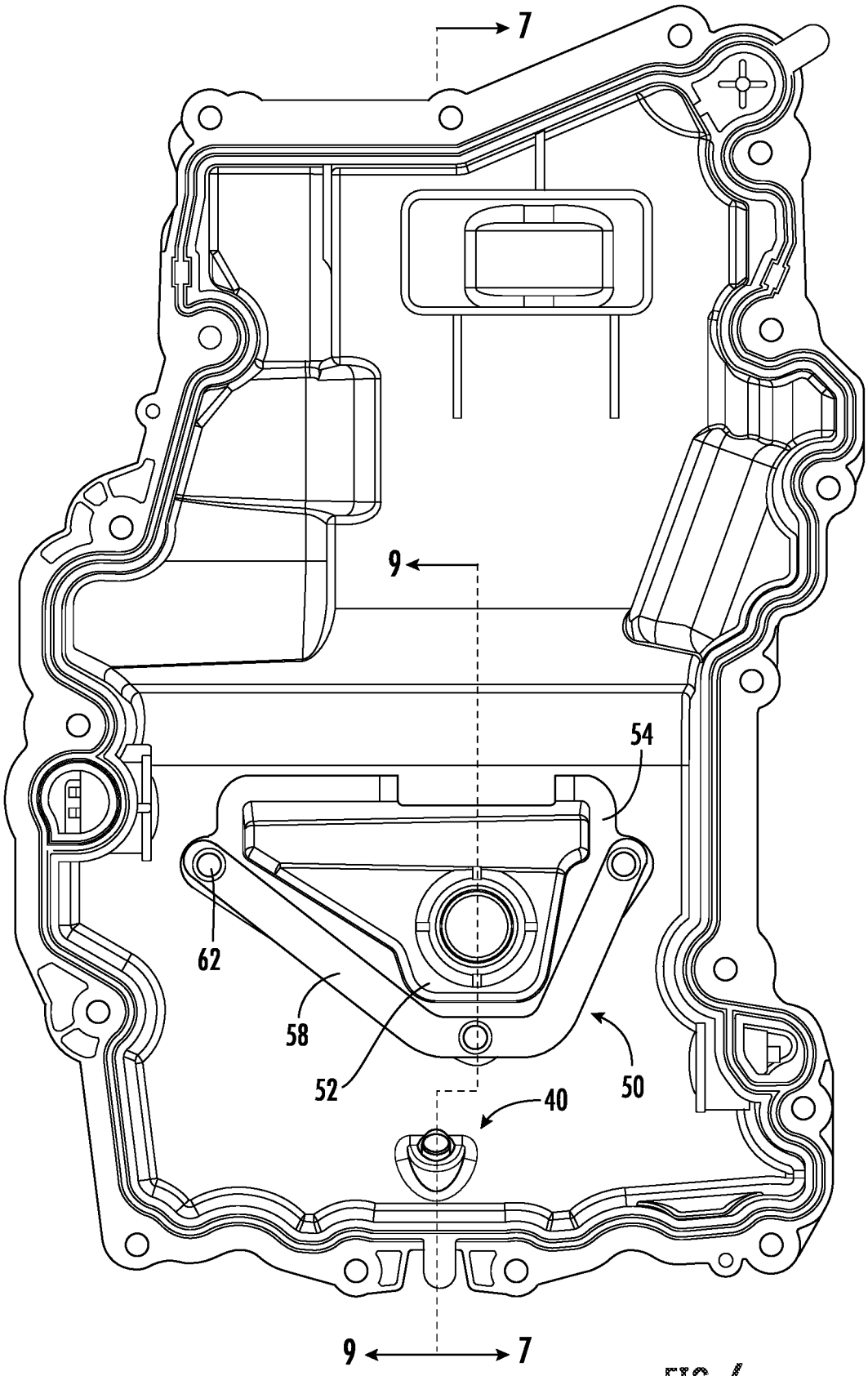
FIG. 6 is a top plan view oil pan in FIGS. 1 and 2.
Figure 7:
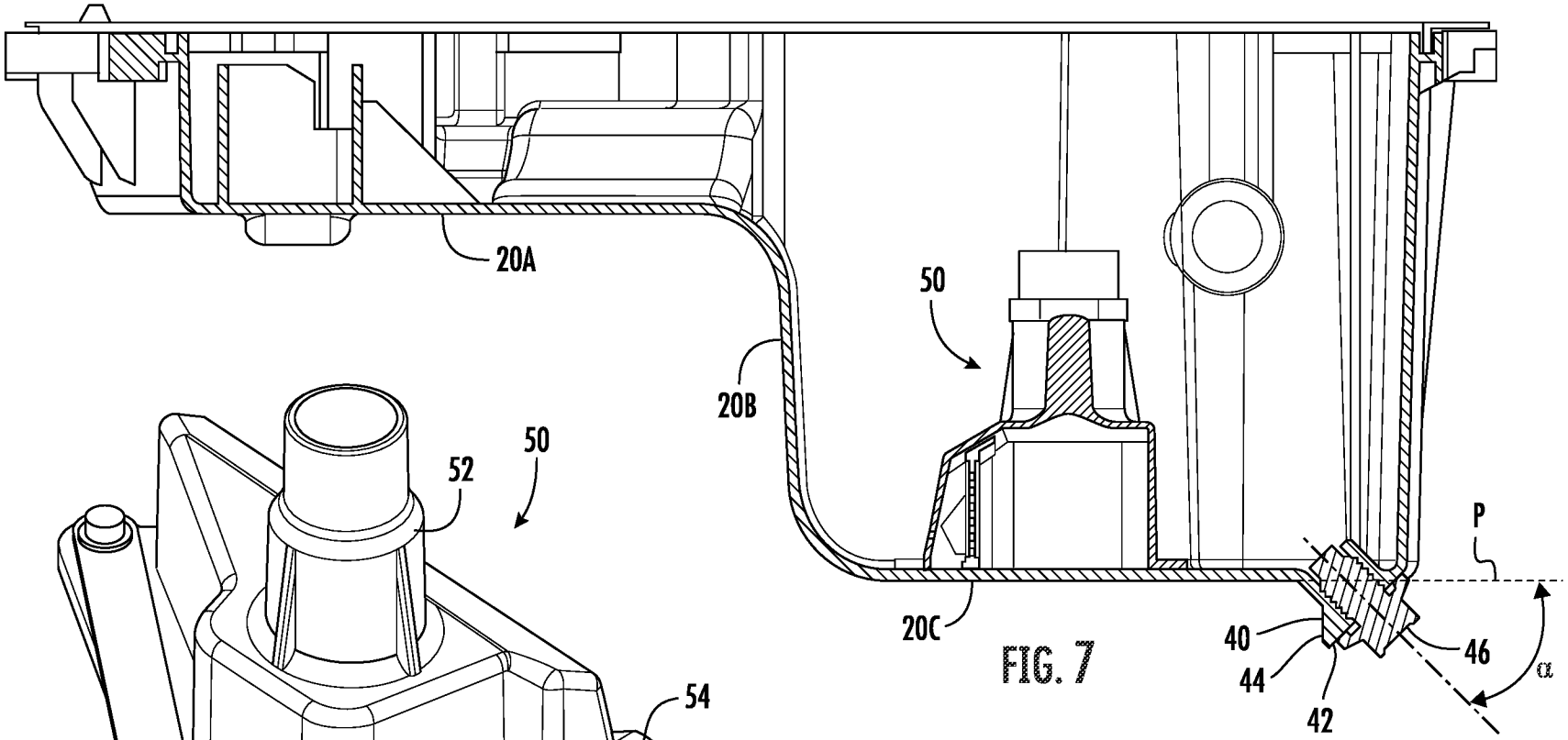
FIG. 7 is a section view along the line 7-7 in FIG. 6.

Still with reference to FIGS. 1 through 5, the bottom wall 20C has multiple attachment points that include the outwardly disposed projections 30, the interior projections 34 and the threads 36, see FIG. 9, therein to receive fasteners 64, as will be described in more detain hereinafter. The bottom wall 20C also has an outwardly projecting oil drain spout 40 with a forward wall 42. The spout 40 is threaded to receive a drain plug 46 with a washer 44, see FIG. 7. The washer may be part of the drain plug 46 or may be a separate component. The projection of the drain spout 40 is angled so that an axis through the drain spout 40 it neither perpendicular or parallel to the bottom wall 20C, see FIGS. 3 and 7. As illustrated in FIGS. 3 and 7, the drain spout 40 of the oil pan 10 has an axis that is angled at about 45° to the bottom wall 20C so that the drain spout 40 it opens below the lowest part of the bottom wall 20C.

Figure 8:
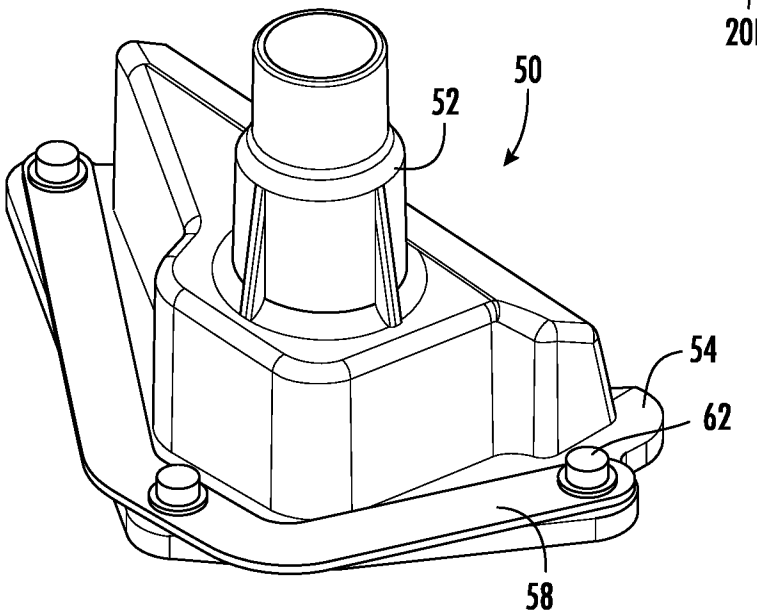
FIG. 8 is a perspective view of the illustrative oil pickup in FIGS. 5-7; and, FIG. 9 is a section view along the line 9-9 in FIG. 6.
Figure 9:
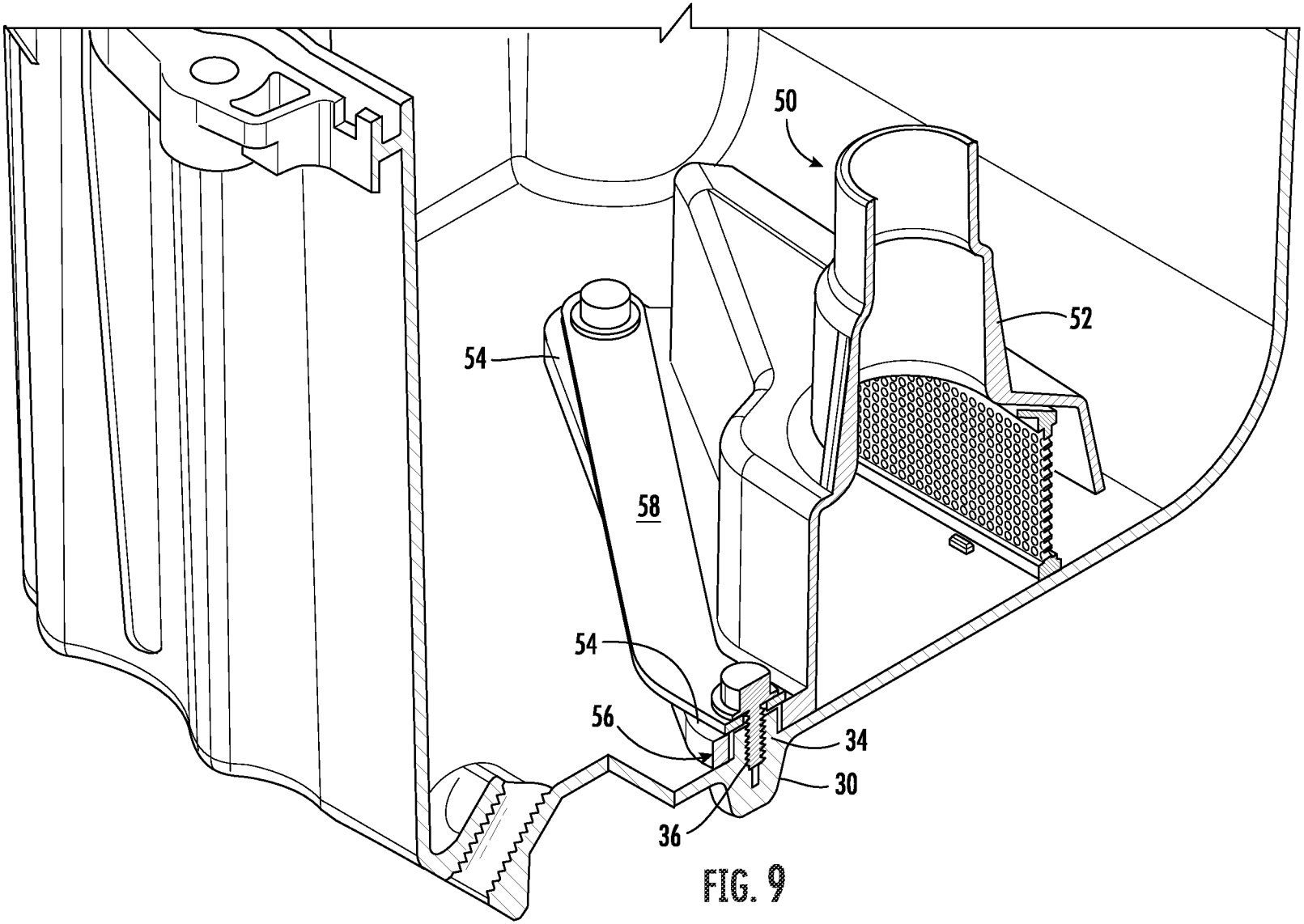

With reference to FIGS. 4-7 and 9, it can be seen that the interior of the oil pan 10 includes an oil tower or pickup 50 that is secured to the bottom wall 20C with mechanical fasteners. The outer and interior configurations and the height of the portion 52 of oil pickup 50 are designed in accordance with the original manufacturer's specifications for the vehicle. The illustrated oil pickup 50 is supported on a collar or base 54, which has a plurality of apertures 56 that are dimensioned to fit over the interior projections 34 on the bottom wall 20C, see FIG. 9. A retainer 58 is configured to complement the shape of the base 54, illustrated in FIG. 8 as somewhat triangular or boomerang like, and has bolt holes 60 that align with the threads 36 of the interior projections 34 to receive securing fasteners 64 that includes a washer 62, see FIG. 4. As shown in FIG. 9, the base 54 passes over the projections 34 and the fasteners 64 in the bolt holes 60 secure the base 54 in the desired position on bottom wall 20C. The base 54 is configured to complement the location of the mechanical fasteners securing the base 54 to the bottom wall 20C.

What is claimed is:

1. An engine oil pan comprising:

a body with side and bottom walls that define an oil reservoir within the body, and an upper rim configured for mounting the body to an engine;

the bottom wall of the body has a plurality of predetermined attachment points;

an oil pickup positioned within the oil reservoir has a designated portion that is configured to be secured to the bottom wall at the plurality of predetermined attachment positions and, a retainer positioned over the designated portion is configured to be secured to the bottom wall at the plurality of predetermined attachment points.

2. The engine oil pan of claim 1, wherein the oil pickup designated portion is a flange.

3. The engine oil pan of claim 2, wherein the flange of the oil pickup has a plurality of through apertures.

4. The engine oil pan of claim 3, wherein at least selected through apertures in the flange of the oil pickup are aligned with selected predetermined attachment positions.

5. The engine oil pan of claim 1, wherein the plurality of attachment points in the bottom wall have outwardly disposed projections.

6. The engine oil pan of claim 1, wherein the plurality of attachment points in the bottom wall have inwardly disposed projections.

7. The engine oil pan of claim 1, wherein the plurality of predetermined attachment points are threaded.

8. The engine oil pan of claim 1, wherein the bottom wall has an outwardly disposed projection that is angled with respect to the bottom wall and configured to receive an oil drain plug.

9. The engine oil pan of claim 8, wherein the angled outwardly disposed projection is threaded to receive a threaded oil drain plug.

10. The engine oil pan of claim 1, wherein the plurality of predetermined attachment positions in the bottom wall are a plurality of projections.

11. The engine oil pan of claim 10, wherein the plurality of projections are threaded and an outwardly disposed projection in the bottom wall is threaded to receive an oil drain plug.

* * * * *